US005924375A

United States Patent [19]

Kaufhold

[11] Patent Number: 5,924,375

[45] Date of Patent: Jul. 20, 1999

[54] AUTOMATIC SEWING APPARATUS FOR SEWING A FLAP ON A WORKPIECE

[75] Inventor: Tobias Kaufhold, Bielefeld, Germany

[73] Assignee: Durkopp Adler Aktiengesellschaft, Germany

[21] Appl. No.: 09/056,029

[22] Filed: Apr. 6, 1998

[30] Foreign Application Priority Data

Apr. 12, 1997 [DE] Germany ..... 197 15 340

[51] Int. Cl.[6] ..... D05B 39/00

[52] U.S. Cl. ..... 112/470.14

[58] Field of Search ..... 112/114, 470.14, 112/470.09, 470.18, 475.06; 223/38

[56] References Cited

U.S. PATENT DOCUMENTS

| | | | |
|---|---|---|---|
| 4,337,881 | 7/1982 | Off et al. | 112/470.14 |
| 4,639,964 | 2/1987 | Binder | 112/470.14 |
| 4,785,749 | 11/1988 | Fischer . | |
| 4,793,272 | 12/1988 | Scholl et al. . | |
| 4,813,362 | 3/1989 | Vogt et al. . | |
| 5,133,271 | 7/1992 | Iwasaki et al. | 223/38 X |
| 5,272,994 | 12/1993 | Scholl et al. . | |
| 5,584,258 | 12/1996 | del Castillo . | |

OTHER PUBLICATIONS

PFSFF Special Service 310–01 No. 296–12–15815, 4 pages, Mar. 1983.

*Primary Examiner*—Ismael Izaguirre
*Attorney, Agent, or Firm*—Lee, Mann, Smith, McWilliams, Sweeney & Ohlson

[57] ABSTRACT

An automatic sewing apparatus comprises a workpiece holder which is designed for manipulation of a pocket flap. It comprises a flap clamp and a transfer clamp and a clamp. During the sewing of a first flap seam, the flap is held by the flap clamp and the clamp. In this case, the transfer clamp is positioned under the flap. Then the flap clamp is released and the clamp is disengaged and simultaneously the transfer clamp is displaced such that on the one hand the flap is folded down over the first flap seam and is simultaneously held in vicinity to the second flap seam to be produced.

10 Claims, 5 Drawing Sheets

AUTOMATIC SEWING APPARATUS FOR SEWING A FLAP ON A WORKPIECE

BACKGROUND OF THE INVENTION

1. Field of the Invention

The invention relates to an automatic sewing apparatus for sewing a flap on a workpiece.

2. Background Art

An automatic sewing apparatus for sewing a flap on a workpiece is known from U.S. Pat. No. 5 272 994, in which a workpiece holder is provided, which comprises a pocket clamping plate and a flap clamping plate. Guide means are provided for the transport of the workpiece holder during the individual sewing jobs. By a single seam in vicinity to the pocket, the flap is sewn on the workpiece, for instance a shirt panel. To this end, after the pocket has been sewn on, the flap is moved towards the pocket for the flap seam to have the collect position relative to the pocket. This known automatic sewing apparatus only can sew on a flap that does not possess a rough, i.e. open, material edge.

The PFAFF information leaflet "PFAFF Special Sevice 310-01 No. 296-12-15815" teaches the application of a flap to a shirt forepart. In this case, the flap is sewn on the shirt panel by a first flap seam. Then the flap is folded down over the first flap seam, after which a second flap seam is sewn through the doubled flap. Also in this case, the edge of the flap lies open under the flap. If this edge is rough, i.e. not finished, then the flap will tend to fray during washing. Moreover, this way of sewing on a flap requires some manual skill of the sewer and is costly, because it is time consuming to sew on a flap in the correct position and without it being warped.

An apparatus for sewing a flap on a shirt forepart is known from U.S. Pat. No. No. 5 584 258, by which a flap can be sewn on fundamentally in the same way as in the publication mentioned first.

SUMMARY OF THE INVENTION

It is the object of the invention to embody an automatic sewing apparatus for sewing a flap on a workpiece, by means of which a flap is sewn on by a first flap seam and, after being folded down over this seam, is fixed by a second flap seam, it being desirable to attain a correct position without the effort of manual skill.

According to the invention, this object is attained in an automatic sewing apparatus for sewing a flap on a workpiece, comprising a sewing machine; a bearing plate for the workpiece; a workpiece holder for the workpiece; a flap clamp connected with the workpiece holder for fixing a flap to a flap supporting surface of the workpiece holder; a recess in the workpiece holder for a first flap seam to be sewn in vicinity to an edge of the flap; a unit for guiding the workpiece holder relative to the sewing machine during the sewing of the first flap seam; a clamp to be lowered into the recess for the flap to be held between the edge and the first flap seam during the sewing of the first flap seam; a transfer clamp which, during the sewing of the first flap seam, is in a first position between the clamp and the flap clamp and under the flap, and which, after the sewing of the first flap seam, is movable over the first flap seam while taking along the flap and can be lowered into a second position on the flap for the flap to be held during the sewing of the second flap seam in the recess; and a unit for guiding the workpiece holder relative to the sewing machine during the sewing of the second flap seam. The gist of the invention resides in that, after the sewing of the first flap seam, the flap is folded down over this first seam by means of a transfer clamp and is then fixed on the workpiece by means of a second flap seam. Manipulation of the flap is exclusively mechanical. When the second position of the transfer clamp—as seen from the first position—is behind the edge of the flap for a second flap seam to be sewn between the transfer clamp and the edge of the flap, then the second flap seam is positioned such that the edge of the flap finds itself between the two flap seams. This way of mounting the flap on a workpiece is especially advantageous when the edge, located between the seams, of the flap is a rough edge which would otherwise tend to fray.

Details of the invention will become apparent from the ensuing description of an exemplary embodiment, taken in conjunction with the drawing.

DESCRIPTION OF THE PREFERRED EMBODIMENT

Figure 1:
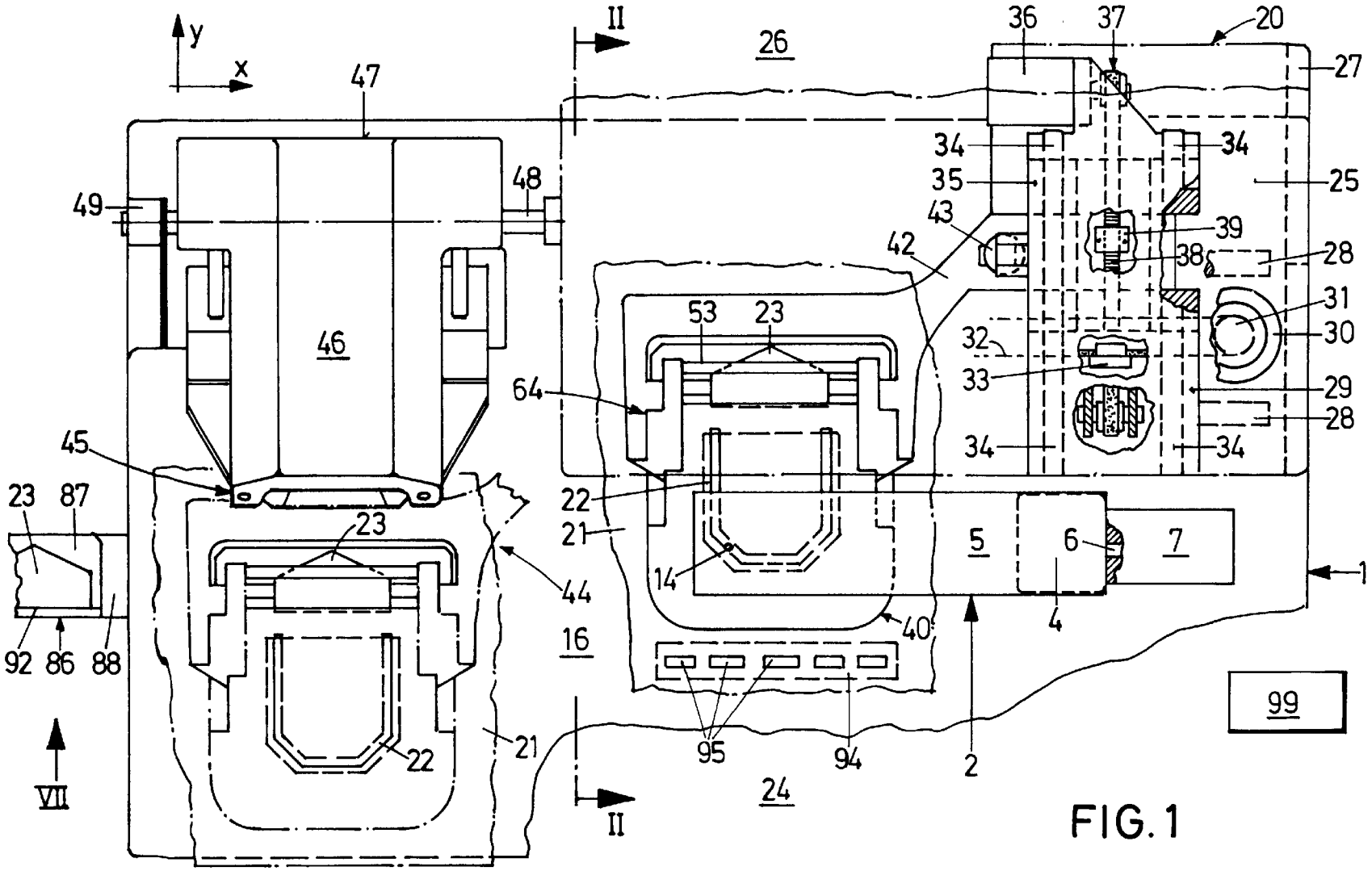
FIG. 1 is a plan view of an automatic sewing apparatus according to the invention in an illustration partially broken open.
Figure 2:
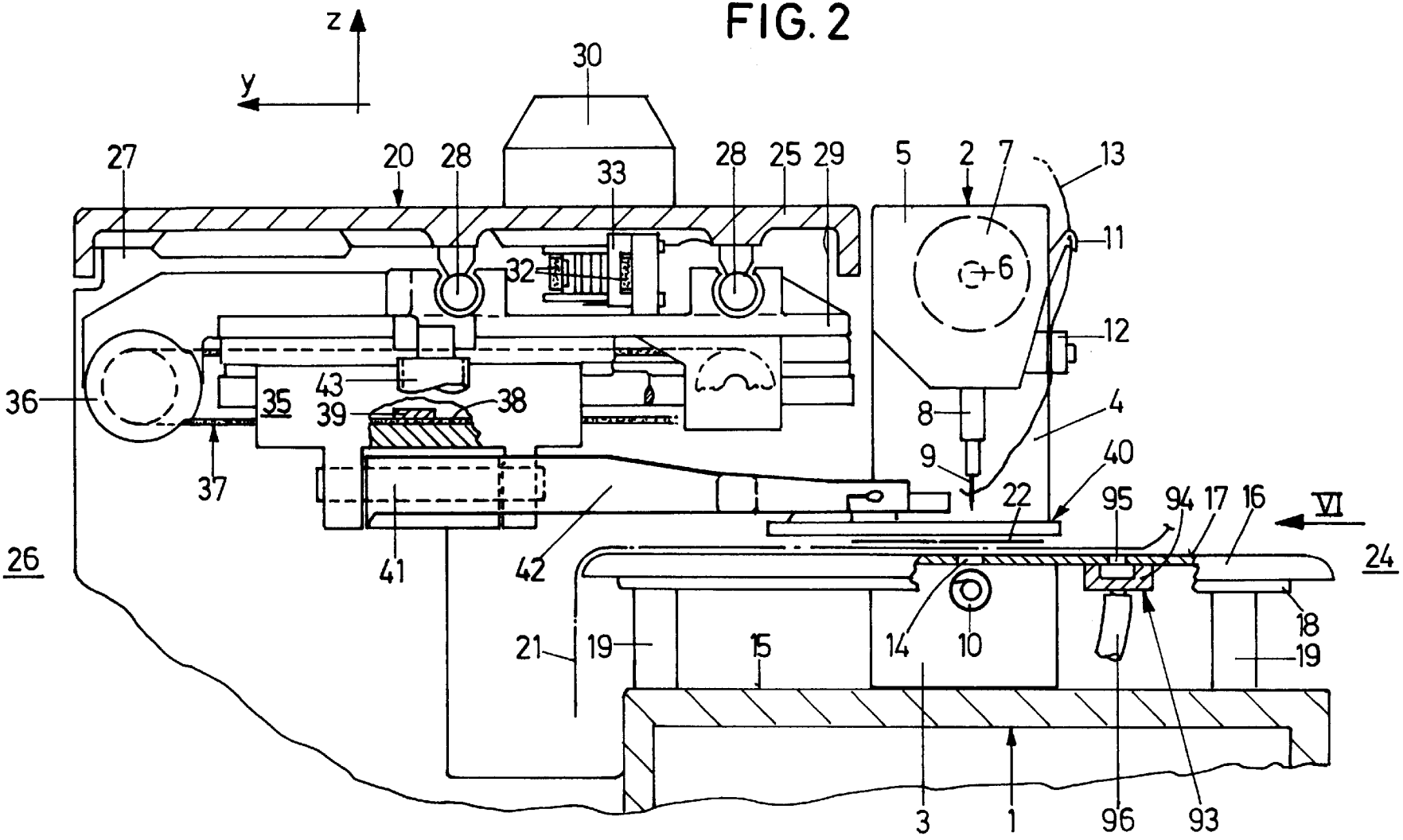
FIG. 2 is a vertical partial section through the automatic sewing apparatus on the line II—II of FIG. 1.
Figure 3:
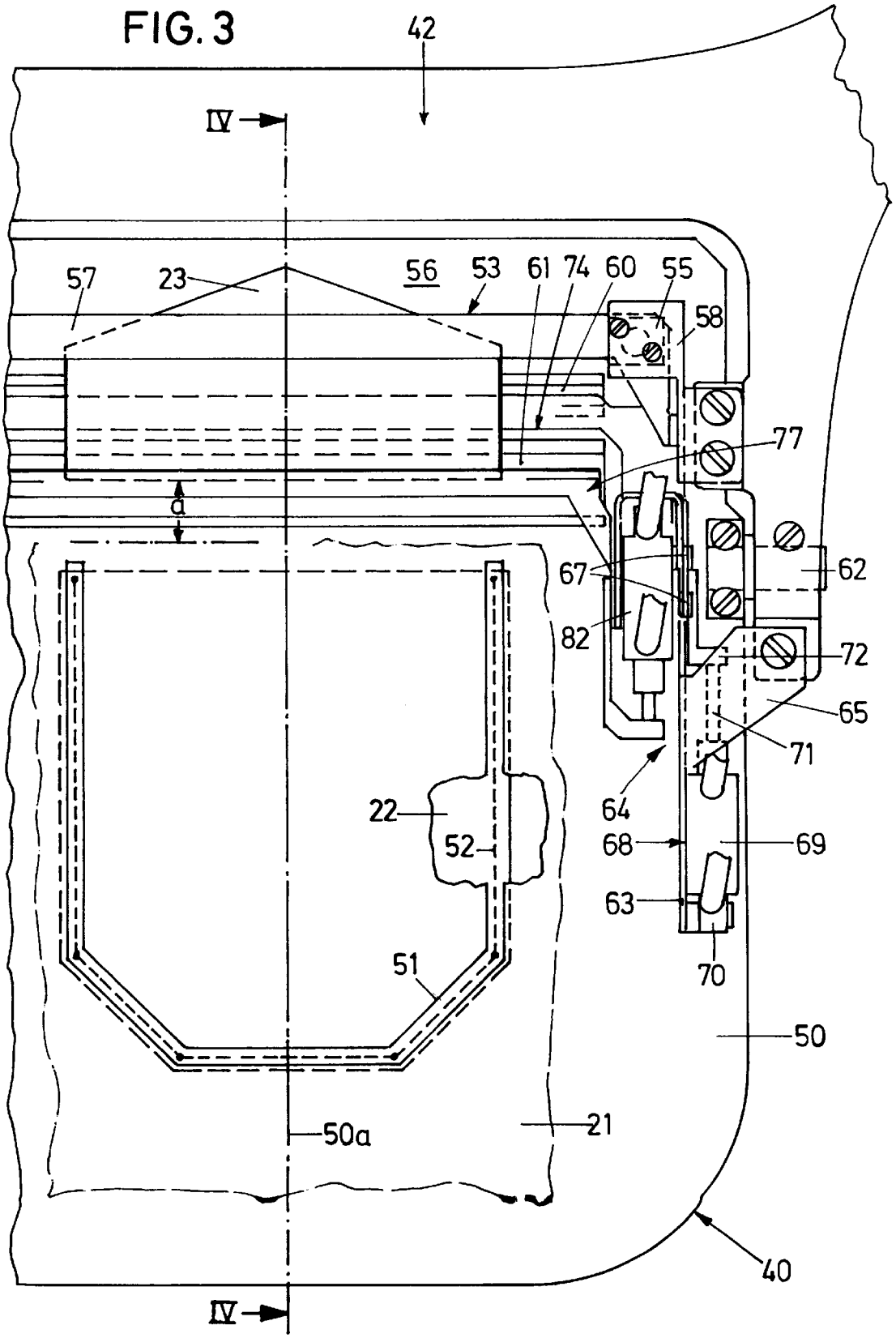
FIG. 3 is an illustration of the transfer plate of the automatic sewing apparatus on an enlarged scale as compared with FIG. 1.

The automatic sewing apparatus illustrated in FIGS. 1 and 2 has a stand 1, on which a sewing machine 2 is stationarily arranged. It conventionally comprises a base plate 3, a standard 4 and an upper arm 5. An arm shaft 6 driven by an electric sewing drive motor 7 is conventionally run in the arm 5 of the sewing machine 2. The drive of a needle bar 8 with a needle 9 and furthermore the drive of a looper 10 situated in the base plate 3 conventionally derive from the arm shaft 6. Via a thread lever 11 and a thread tightener 12, the needle 9 is supplied with a thread 13, which is conventionally seized by the looper 10, when the needle 9 plunges through the stitch hole 14 into the base plate, and which is connected with an under-thread not shown to form a two-thread lock-stitch seam.

A bearing plate 16, of which the upper side defines a sewing plane 17, is arranged on the stand 1 above the latter's upper side 15. This bearing plate 16 is—at least partially—supported on a supporting plate 18, which is retained by supports 19 on the stand 1. The bearing plate 16 also rests on the base plate 3 of the sewing machine 2 and, within the traveling path of the needle bar 8 with the needle 9 defined as the z-direction, comprises the stitch hole 14 which permits the needle 9 to pass towards the looper 10.

A guide means 20 for workpieces 21, 22, 23 to be sewn to each other is provided above the bearing plate 16. Seen from the operator's side 24, it is arranged after the sewing machine 2. It has an upper base plate 25, which is supported by way of vertical supporting walls 27 on the stand 1 in the latter's rear portion 26 opposite to the operator's side 24 and—seen from the operator's side—after the bearing plate 16. On the bottom side of this base plate 25, guide rods 28 are arranged, which extend parallel to each other in the x-direction and which have an x-carriage 29 displaceably supported on them. This x-carriage 29 is driven by an electric motor 30, which may be a gear motor, via a timing belt drive 31, of which the timing belt is connected with the x-carriage 29 by means of a fastening device 33.

Another pair of guide rods 34 extending parallel to each other in the y-direction, i.e. at right angles to the x-direction, are arranged on the bottom side of the x-carriage 29 and have a further carriage, a y-carriage 35, guided on them for displacement in the y-direction. Both carriages 29, 35 are suspendedly guided on the respective guide rods 28 and 34. The drive of the y-carriage 35 is effected via a timing belt drive 37 by an electric motor 36—if necessary also a gear motor—arranged in the rear portion 26 on the x-carriage 29. The timing belt 38 of this timing belt drive 37 is secured to the bottom side of the y-carriage 35 by means of a fastening device 39. The x-direction and the y-direction extend perpendicularly to each other and perpendicularly to the z-direction. The x-, y- and z-direction form a normal Cartesian coordinate system. The x- and the y-directions extend in parallel to the sewing plane 17. The x-direction is parallel to the main longitudinal direction of the sewing machine 2, i.e. parallel to the arm shaft 6.

On the bottom side of the y-carriage 35, a workpiece holder 40 is supported to be tiltable about a tilt axis 41 extending parallel to the y-direction. To this end, the workpiece holder 40 is secured to the end of a transfer lever 42, the other end of which is supported on the tilt axis 41. The transfer lever 42 is twice bent at right angles, namely, on the one hand, away from the workpiece holder 40 in the y-direction towards the rear portion 26 and, on the other hand, from the bearing plate 16 upwards in the z-direction towards the bottom side of the y-carriage 35. Between the tilt axis 41 and the workpiece holder 40, a lift and press drive 43 is provided, engaging on the one hand with the transfer lever 42 and on the other hand with the y-carriage 35. It is a linear drive conventionally designed as a pneumatically actuated piston-cylinder drive. As seen from the above, the total guide means 20 with all its accompanying components is arranged above the bearing plate 16, i.e. it can be arranged very close to the sewing machine 2.

The sewing machine 2 and the guide means 20 are preceded by a preparatory station 44, where the first workpiece 21, for instance a shirt forepart, and the second workpiece, which is a cut-out pocket, are placed in a position relative to each other necessary for sewing. The pocket blank is folded by means of a folding device 45 in the preparatory station 44, The folding device 45 has a cover-like carrier 46, which is arranged above the bearing plate 16 and projects over the latter towards the rear portion 26 of the stand 1. At its rear end, the carrier 46 has a lever arm 47 extending downwards. In the vicinity of its transition into this lever arm 47, the carrier 46 is supported tiltably about a tilt axis 48, which extends in parallel to the x-direction and is supported in a bearing arm 49 stationary within the stand. The only partially shown folding tools necessary to fold the second workpiece 22 (cut-out pocket), by means of which the pocket blank is bent over and positioned accurately on the lower first workpiece 21, are accommodated in the carrier 46 projecting freely over the bearing plate 16. Such folding devices are generally known and commercial in practice so that a detailed description is not necessary. By way of example reference is made to U.S. Pat. No. 4813362, U.S. Pat. No. 4793272, and U.S. Pat. No. 4785749.

The workpiece holder 40 comprises a transfer plate 50 with a slit 51 which is for instance approximately U-shaped and the extension of which corresponds to the course of the seam 52 to be produced and by which the second workpiece 22 (pocket blank) is to fixed to the first workpiece 21 (shirt forepart). The transfer plate 50 is structured in mirror symmetry to a central axis 50*a* so that basically, the description of one side is sufficient.

A U-shaped pocket-flap clamp 53 is mounted on the transfer plate 50 and is pivotable about bearings 54 disposed in the lateral portion of the transfer plate. By means of clamping drives acting on its sides, the clamp 53 can be pressed on a flap supporting surface 56 of the transfer plate 50. These drives 55 are piston-cylinder drives which can be actuated pneumatically unilaterally and which, upon pneumatic actuation, press a clamping bar 57 of the flap clamp 53 on the supporting surface 56. Recuperating springs 59 are attached to lateral supports 58 which are mounted on the transfer lever 42 and to each of which a drive 55 is fixed; when the drives 55 are relieved, the springs 59 move the flap clamp 53 upwards so that the latter's clamping bar 57 is lifted off the supporting surface 56. In parallel to the clamping bar 57 and neighboring the latter, a first recess 60 of the type of a slit is formed in the transfer plate 50 in the direction towards the slit 51. In parallel thereto, another, second recess 61 in the form of a slit is formed in the transfer plate 50 in the direction towards the slit 51.

Figure 4:
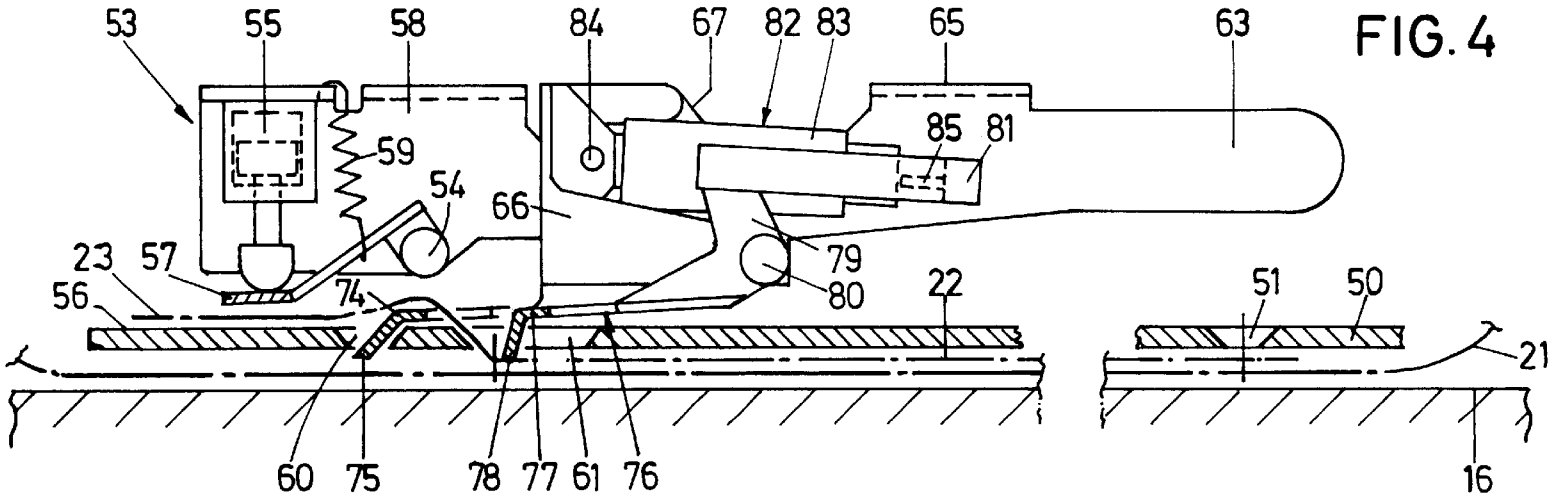
FIG. 4 is a cross section through the transfer plate on the line IV—IV of FIG. 3 on an enlarged scale as compared with FIG. 4.
Figure 5:
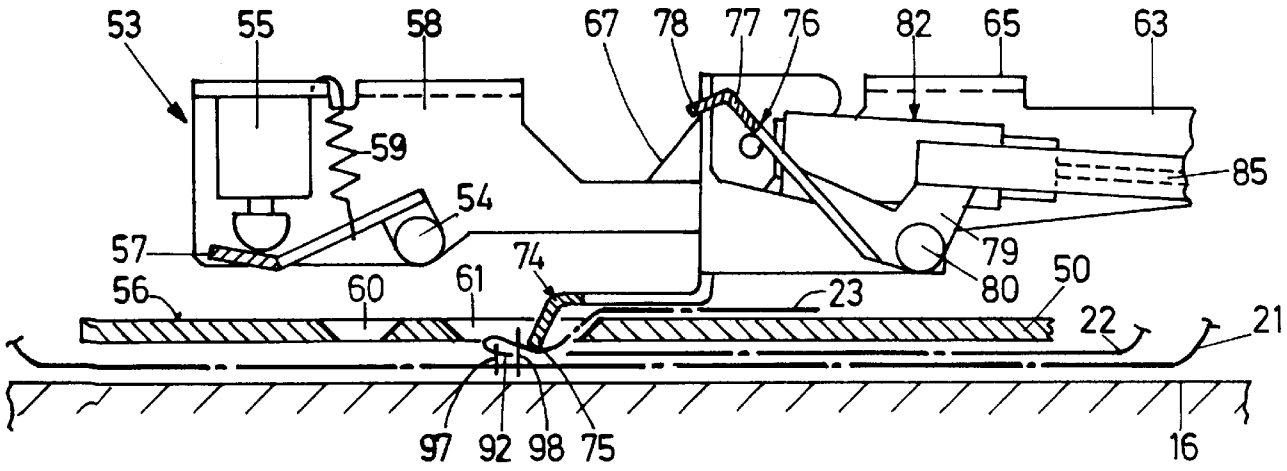
FIG. 5 is an illustration in accordance with FIG. 4, however in a different working position.

The transfer plate 50 is connected with the transfer lever 42 by means of bolts 62 which can be arrested by clamping and ensure the transfer plate 50 to be aligned relative to the transfer lever 42. On both sides of the transfer lever 42, support arms 63 of a pocket-flap holder 64 are fixed by means of bent off brackets 65. The supports 58 and the support arms 63 constitute a unified component. A pivoting and displacing member 66 is articulated to each support arm 63 by means of a parallel connecting rod 67 on which acts a pivoting and displacing drive 68. This is a piston-cylinder drive which can be actuated pneumatically and the cylinder 69 of which is articulated to the support arm 63 by means of a joint 70. Its piston rod 71 is joined to the parallel connecting rod 67 via a lever 72. Upon motions of retraction and extraction of the piston rod 71 relative to the cylinder 69, the pivoting and displacing member 66 is pivoted on a segment of an arc of a circle 73 which is roughly outlined in FIG. 6. FIG. 4 shows the position of the pivoting and displacing member 66 with the piston rod 71 extracted and FIG. 5 shows it with the piston rod 71 retracted in the cylinder 69.

Figure 6:
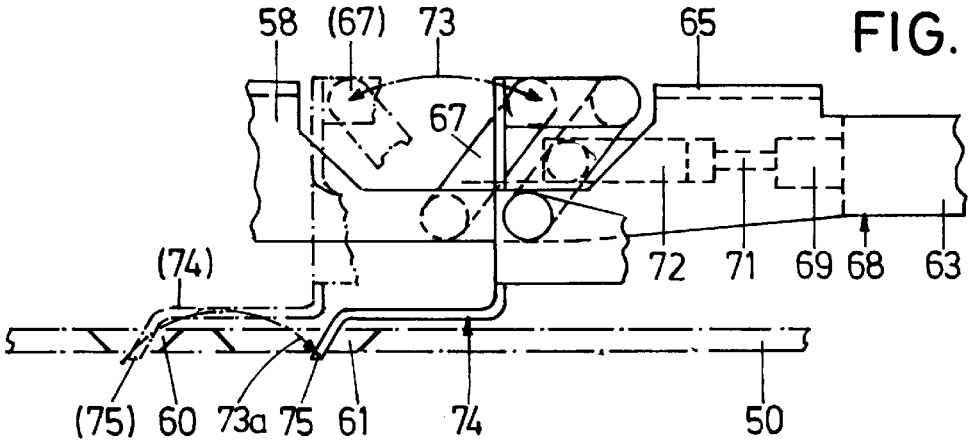
FIG. 6 is a view of pair of a subassembly of FIGS. 4 and 5.

In FIG. 6, the position of the pivoting and displacing member 66 with the piston rod 71 retracted is outlined by solid lines and the position of the pivoting and displacing member 66 with the piston rod 71 in its extracted position is shown by dot-dashed lines. A transfer clamp 74 in the form of a bar is disposed between the two pivoting and displacing member 66 and, upon the described pivoting motion performed by the parallel connecting rod 67 along a segment of an arc of a circle 73*a* that corresponds to the segment of an arc of a circle 73, this transfer clamp 74 is transported from a first position in the first recess 60 (see FIG. 4) into a second position in the second recess 61 (see FIG. 5). As seen in FIGS. 4 and 5, the transfer clamp 74 comprises a lower clamping edge 75 which, in the first and second position, reaches through the first and second recess 60 and 61 downwardly to the bearing plate 16.

Furthermore, a fixing clamp 76 is pivotably lodged between the two pivoting and displacing members 66, the fixing clamp 76 comprising a bar-type clamp 77 which is provided with a clamping edge 78 which again may reach through the second recess 61 in the direction towards the support plate 16. By means of angle levers 79, the fixing clamp 76 is mounted on the pivoting and displacing members 66 around pivot links 80. A fixing clamp drive 82 acts on the angle levers 79 via intermediate levers 81, which again is a piston-cylinder drive to be actuated pneumatically. The respective cylinder 83 is articulated to the pivoting and displacing member 66 by means of a pivot link 84, while its piston rod 85 acts on the intermediate lever 81. When the piston rod 85 is retracted in the cylinder 81, the clamp 77, according to FIG. 4, is positioned in the second recess 61. In the extracted position of the piston rod 85, the clamp 77, according to FIG. 5, is in a position pivoted upwards relative to the transfer plate 50. The fixing clamp 76, inclusive of the fixing clamp drive 82, is displaced by means of the pivoting and displacing members 66 from the second recess 61 in the direction towards the slit 51 and vice versa.

In the preparatory station 44, the third workpiece 23, which is a flap, i.e. a pocket flap, is deposited as a pre-sewn piece on the flap-supporting surface 56 of the transfer plate 50. To this end, a flap feed 86, which comprises a flap holder 87, is mounted on the stand 1, preferably on the lower side of the bearing plate 16. This flap holder 87 is disposed above the bearing plate 16 and guided by a U-shaped arm 88 for displacement in a sliding bearing 89 on the lower side of the bearing plate 16. A linear drive 90 for displacing the arm 88 with the flap holder 87 in the x-direction is provided here, too. The flap holder 87 substantially consists of a sheet on which a flap clip 91 is provided, by means of which a flap 23 placed on the flap holder 87 is safeguarded against getting out of place during the feed motion.

The flap 23 possesses a rough edge 92 in the vicinity of where it is to be sewn on the first workpiece 21; in this area the flap 23 is not hemmed, fundamentally tending to fray.

In the vicinity of the sewing machine 2, a mechanism 93 is provided for fixing the first workpiece 21 relative to the bearing plate 16. It is a suction mechanism, i.e. according to the illustration of FIG. 2, a suction box 94 is provided on the underside of the bearing plate 16 and is connected with the latter's top side by means of aspirating ports 95 in the bearing plate 16. A vacuum tube 96 is connected to the suction box 94 to which is admitted a vacuum source (not shown).

The drives specified are in connection with a control unit 99 which, upon corresponding commands entered by an operator, passes the necessary control commands to the drives.

The way of working is as follows:

A flap 23 is inserted in the flap holder 87 by the operator, where it is fixed under the flap clip 91. The flap 23 rests aligned on the flap holder 87. Then the operator places a first workpiece 21, for instance a shirt panel, on the bearing plate 16, adjusting it accurately by means of marks (not shown) provided on the bearing plate. Further, the operator inserts a second workpiece 22, i.e. a pocket blank, in the folding device 45 where this second workpiece 22 is folded and positioned on the first workpiece in known manner. During these operations, the transfer plate 50 is not in the preparatory station 44.

Figure 8:
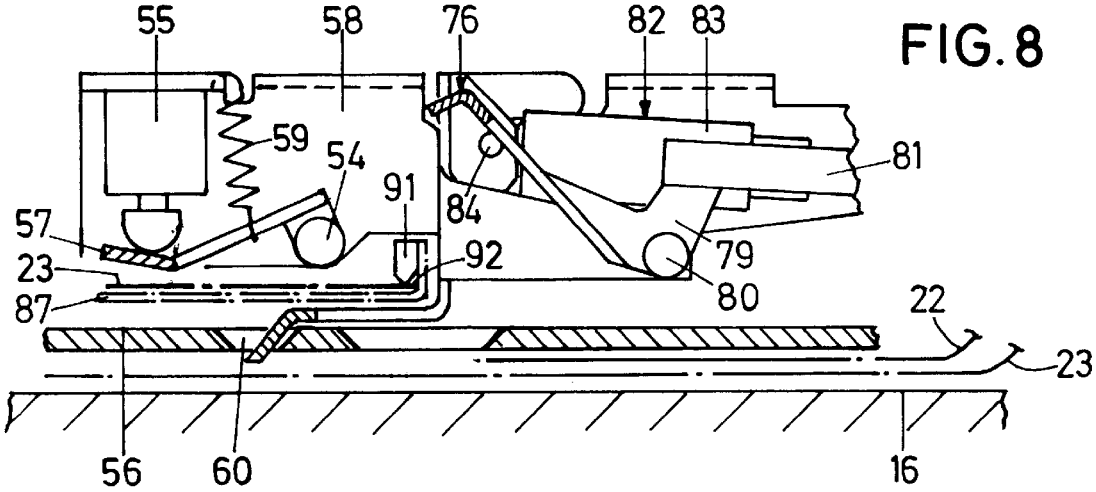
FIG. 8 is a sectional view corresponding to FIG. 4 with the feeding on to the transfer plate of a flap to be sewn on being illustrated.
Figure 7:
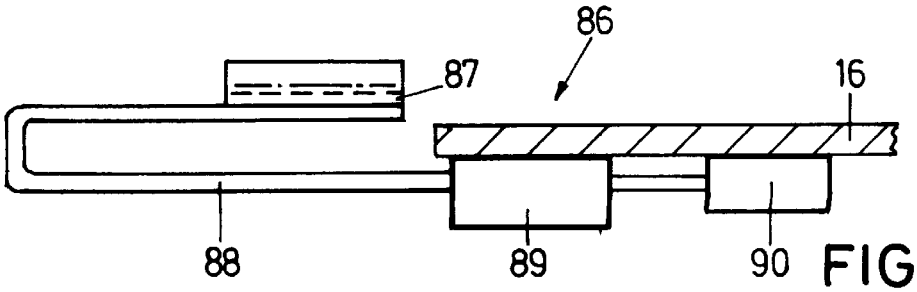
FIG. 7 is a view of a feed according to the arrow VII of FIG. 1.

After the second and the first workpieces 22 and 21 have been positioned one upon the other, the transfer plate 50, in a condition lifted off the bearing plate 16, is moved into the preparatory station 44 and lowered onto the bearing plate 16, whereby the two workpieces 21, 22 are pressed on each other. Prior to the insertion of the flap 23 under the flap clamp 53, the transfer clamp 74 is in the position seen in FIG. 4, i.e. in the first recess 60. The piston rod 71 of the pivoting and displacing drive 68 is extracted from the cylinder 69. The fixing clamp 76 is in its upward position seen in FIGS. 5 and 8. The clamping bar 57 is in its upward position (FIG. 8). Now the linear drive 90 of the flap feed 86 is actuated, whereby the flap holder 87 with the flap 23 is inserted between the pocket-flap clamp 53 and the flap supporting surface 56. Now compressed air is admitted to the clamping drive 55, as a result of which the clamping bar 57 is pressed against the flap 23. Then the flap clip 91 is released and the linear drive 90 is actuated in the opposite direction, as a result of which the flap holder 87 is again moved in the opposite direction out of the preparatory station 44. The flap 23 is held by the clamping bar 57 and fixed between the latter and the flap supporting surface 56. In this case, the transfer clamp 74 is positioned under the flap 23, i.e. the flap 23 overlaps the transfer clamp 74 and extends as far as into the second recess 61 where its rough edge 92 is located.

By corresponding actuation of the motors 30 and 36, the transfer plate 50 with the three workpieces 21, 22, 23 is moved under the sewing machine 1 and the approximately U-shaped seam 52 is sewn, by means of which the second workpiece 22, the pocket, is fixed to the first workpiece 21.

After the seam 52 has been sewn while the first and the second workpiece 21, 22 are moved on the bearing plate 16 under the sewing machine 2, the mechanism 93 for fixing the workpieces 21, 22 is actuated by underpressure while the workpiece holder 40 is at a standstill so that these workpieces 21, 22 are fixed on the bearing plate 16. By corresponding actuation of the drive 43 and the electric motor 36, the workpiece holder 40 is lifted off the workpieces 21, 22, moved by a length a towards the pocket 22, i.e. in the negative y-direction, and placed again on the workpieces 21, 22. The flap 23 is now in its correct position relative to the pocket 22. The underpressure is switched off so that the mechanism 93 is de-activated.

Simultaneously or before, the fixing clamp drive 82 has been actuated in such a way that the fixing clamp 76 is moved downwards into its position seen in FIG. 4. Its clamping edge 78 presses the flap 23 on the first workpiece 21 in the vicinity of the flap's rough edge 92. By corresponding actuation of the motors 30 and 36, a first flap seam 97 is sewn in the second recess 61. Then the fixing clamp drive 82 is actuated in such a way that the fixing clamp 76 is moved upwards into its disengaged position seen in FIG. 8. Directly afterwards the pivoting and displacing drive 68 is actuated in such a way that the parallel connecting rods 67 are moved from their position seen in FIG. 4 into their position seen in FIG. 5 so that the transfer clamp 74 is moved from the first recess 60 into the second recess 61 in accordance with the segment of an arc of a circle 73*a* that corresponds to the segment of an arc of a circle 73, folding the flap 23 down over the first flap seam 97. As seen in FIG. 5, the clamping edge 75 of the transfer clamp 74 then presses the flap 23 on the first workpiece 21 in proximity to the first flap seam 97. Now a second flap seam 98 can be sewn there, which is applied such that the rough edge 92 is positioned between the first seam 97 and the second seam 98. As a result, the rough edge 92 is covered. During this process, the fixing clamp 76 is disengaged as seen in FIG. 5.

If the device is designed such that the distance between the rough edge 92 and the first flap seam 97 is greater, for instance 5 mm, then the second flap seam 98 runs through two layers of the third workpiece (flap) and through the first workpiece (shirt forepart).

Manipulations of the flap 23 can be also be made without a pocket as a second workpiece 22 having been sewn on. For instance, pocket flaps are sometimes applied for purely decorative reasons.

What is claimed is:

1. An automatic sewing apparatus for sewing a flap (23) on a workpiece (21), comprising a sewing machine (2), a bearing plate (16) for the workpiece (21), a workpiece holder (40) for the workpiece (21), a flap clamp (53) connected with the workpiece holder (40) for fixing a flap (23) to a flap supporting surface (56) of the workpiece holder (40), a first recess (61) in the workpiece holder (40) for a first flap seam (97) to be sewn in vicinity to an edge (92) of the flap (23), a unit for guiding the workpiece holder (40) relative to the sewing machine (2) during the sewing of the first flap seam (97), a clamp (77) to be lowered into the recess (61) for the flap (23) to be held between the edge (92) and the first flap seam (97) during the sewing of the first flap seam (97), a transfer clamp (74), which during the sewing of the first flap seam (97), is in a first position between the clamp (77) and the flap clamp (53) and under the flap (23), and which after the sewing of the first flap seam (97), is movable over the first flap seam (97) while taking along the flap (23) and can be lowered into a second position on the flap (23) for the flap (23) to be held during the sewing of the second flap seam (98) in the recess (61), and a unit for guiding the workpiece holder (40) relative to the sewing machine (2) during the sewing of the second flap seam (98).

2. An automatic sewing apparatus according to claim 1, wherein the second position of the transfer clamp (74) as seen from the first position—is behind the edge (92) of the flap (23) for the second flap seam (98) to be sewn between the transfer clamp (74) and the edge (92) of the flap (23).

3. An automatic sewing apparatus according to claim 1, wherein the transfer clamp (74) is movable along an arc (73*a*) from the first position into the second position.

4. An automatic sewing apparatus according to claim 1, wherein in the first position, the transfer clamp (74) is located in a second recess (60) of the workpiece holder (40).

5. An automatic sewing apparatus according to claim 3, wherein the transfer clamp (74) is connected with a pivoting and displacing member (66) which is movable along a segment of an arc of a circle (73, 73*a*) by a parallel connecting rod (67).

6. An automatic sewing apparatus according to claim 5, wherein the pivoting and displacing member (66) is pivotably displaceable by means of a drive (68).

7. An automatic sewing apparatus according to claim 5, wherein the clamp (77) is pivotably articulated to the pivoting and displacing member (66).

8. An automatic sewing apparatus according to claim 1, wherein the workpiece holder (40) is provided with a slit (51) for a pocket (22) to be sewn on the workpiece (21) priori to the sewing of the first flap seam (97), a mechanism being provided for displacing the workpiece holder (40) towards the pocket (22) after the pocket (22) is sewn on, and a mechanism (93) being provided for fixing the workpiece (21) on the bearing plate (16) during displacement of the workpiece holder (40).

9. An automatic sewing apparatus according to claim 8, wherein the mechanism (93) for fixing the workpiece (21) on the bearing plate (16) is a suction mechanism formed in the bearing plate (16).

10. An automatic sewing apparatus according to claim 1, wherein a flap feed (86) is provided, having a flap holder (87) to be inserted between the flap supporting surface (56) and the flap clamp (53).

* * * * *